US012043469B1

(12) United States Patent
Graybill

(10) Patent No.: US 12,043,469 B1
(45) Date of Patent: Jul. 23, 2024

(54) WATER BOTTLE LID FITTING FOR CONVERSION OF WATER BOTTLE TO WATER PIPE

(71) Applicant: Corbin Graybill, San Marcos, CA (US)

(72) Inventor: Corbin Graybill, San Marcos, CA (US)

( * ) Notice: Subject to any disclaimer, the term of this patent is extended or adjusted under 35 U.S.C. 154(b) by 413 days.

(21) Appl. No.: 17/511,662

(22) Filed: Oct. 27, 2021

Related U.S. Application Data

(60) Provisional application No. 63/118,120, filed on Nov. 25, 2020.

(51) Int. Cl.

| | |
|---|---|
| ***A24F 5/00*** | (2006.01) |
| ***A24F 1/30*** | (2006.01) |
| ***A24F 3/00*** | (2006.01) |
| ***A24F 7/00*** | (2006.01) |
| ***A45F 3/18*** | (2006.01) |
| ***B65D 47/28*** | (2006.01) |
| ***B65D 51/24*** | (2006.01) |
| ***B65D 81/36*** | (2006.01) |

(52) U.S. Cl.
CPC ..... *B65D 81/365* (2013.01); *A24F 1/30* (2013.01); *A24F 3/00* (2013.01); *A24F 5/00* (2013.01); *A24F 7/00* (2013.01); *A45F 3/18* (2013.01); *B65D 47/286* (2013.01); *B65D 51/242* (2013.01)

(58) Field of Classification Search
CPC ..... A24F 1/30; A24F 7/00
See application file for complete search history.

(56) References Cited

U.S. PATENT DOCUMENTS

| | | | | |
|---|---|---|---|---|
| 2,035,782 | A * | 3/1936 | Bernard | A24F 1/00 131/180 |
| 2021/0261307 | A1* | 8/2021 | Ashton | A24F 13/12 |
| 2021/0378295 | A1* | 12/2021 | Gambino | A24F 1/30 |

* cited by examiner

*Primary Examiner* — Christopher M Rodd
*Assistant Examiner* — Jennifer A Kessie
(74) *Attorney, Agent, or Firm* — Sandy Lipkin

(57) ABSTRACT

A retrofitted lid for a standard metallic water bottle that converts the water bottle into a water pipe. The retrofitted lid is designed to fit standard tops of water bottles and includes a cylindrical base with an inverted cork underneath that allows the cylindrical base to be easily pushed down without the need for screwing onto a water bottle. The top of the device, on top of the cylindrical base includes a raised substantially oblong portion that includes a first round aperture for the placement therethrough of a step, carburetor piece and bowl and a second rectangular aperture for the passage out of the device of generated smoke. The top portion includes a removable retaining clip that keeps the slideable portion flush with the top portion. The slideable portion has a top and a bottom and two sidewalls extending downward from the top and past the bottom, thereby creating a female mating space to connect to the top portion of the lid. Flanges at the bottom of the side walls create grooves that mate with the top portion of the device. An option handle is attached to the lid for easy carrying. The slideable lib is engineered to only slide on to the top portion in one direction.

8 Claims, 9 Drawing Sheets

WATER BOTTLE LID FITTING FOR CONVERSION OF WATER BOTTLE TO WATER PIPE

BACKGROUND OF THE INVENTION

Reference to Prior Application

This application claims priority of the provisional patent application 63/118,120, filed Nov. 25, 2020 entitled WATER BOTTLE LID FITTING FOR CONVERSION OF WATER BOTTLE TO WATER PIPE by Corbin Graybill.

FIELD OF THE INVENTION

The field of this invention relates generally to the field of

DESCRIPTION OF THE PRIOR ART

A water pipe is a filtration device generally used for smoking *cannabis*, tobacco or other herbal substances. A water pipe (also known as a bong) is typically constructed from an air and water-tight vessel by adding a bowl and stem apparatus which guides air downward to below water level where it bubbles upward during use. To get fresh air into the water pipe and to access all of the smoke, a hole known as the carburetor is placed on the lower part of the water pipe above the water level, which is covered until the end when it is released to allow the smoke to travel therethrough.

It is the object of the instant invention to provide a lid fixture for a metal reuseable water bottle that is retrofitted to transform the reuseable metal water bottle into a water pipe.

SUMMARY OF THE INVENTION

The basic embodiment of the present invention teaches a retrofitted lid for a reuseable metallic water bottle comprising: a cylindrical base portion, said cylindrical base portion having a top and a bottom and a cylindrical sidewall extending downward from said top and past said bottom creating a space thereunder; an inverted cork place underneath said space under cylindrical base portion; a raised member on said top of said cylindrical base portion wherein said raised member further comprises: a first end; a second end; a first side between said first and second ends; and a second side between said first second ends; a first aperture in said raised member that extends through said bottom of said cylindrical base portion; a second aperture in said raised member that extends through said bottom of said cylindrical base portion; a slideable lid for attachment to said raised member, said slideable lid further comprising: a first end that corresponds to said first end of said raised member; a second end that corresponds to said second end of said raised member; a top; a bottom; a first sidewall that extends downward from said top and passes beyond said bottom; a second sidewall that extends downward from said top and passes beyond said bottom, said first and second sidewalls being substantially parallel to each other wherein said first and second sidewalls terminate in inwardly facing flanges thereby creating grooves on either side of said slideable lid that correspond to said first and second sides of said raised portion; and an aperture on said second end of said slideable lid; a retaining clip that is conformed to said first end of said raised member which provides a stop and securing point for said slideable lid when completely attached to said raised portion; a stem that extends through said bottom of said cylindrical base and that terminates at the top with a carburetor portion that seats into said first aperture in said raised member; and a bowl that fits into said carburetor portion.

The above embodiment can be further modified by defining that said inverted cork is made of silicone.

The above embodiment can be further modified by defining that said first aperture is circular.

The above embodiment can be further modified by defining that said second aperture is rectangular.

The above embodiment can be further modified by defining that said aperture on said second end of said slideable lid is rectangular.

The above embodiment can be further modified by defining that a handle is attached to said cylindrical base.

The above embodiment can be further modified by defining that said first aperture is proximate said handle and said second aperture is distal said handle.

An alternate embodiment of the instant inventions teaches a method of converting a standard water bottle into a water pipe comprising the steps of: acquiring a retrofitted lid, said retrofitted lid further comprising: a cylindrical base portion, said cylindrical base portion having a top and a bottom and a cylindrical sidewall extending downward from said top and past said bottom creating a space thereunder; an inverted cork place underneath said space under cylindrical base portion; a raised member on said top of said cylindrical base portion wherein said raised member further comprises: a first end; a second end; a first side between said first and second ends; and a second side between said first second ends; a first aperture in said raised member that extends through said bottom of said cylindrical base portion; a second aperture in said raised member that extends through said bottom of said cylindrical base portion; a slideable lid for attachment to said raised member, said slideable lid further comprising: a first end that corresponds to said first end of said raised member; a second end that corresponds to said second end of said raised member; a top; a bottom; a first sidewall that extends downward from said top and passes beyond said bottom; a second sidewall that extends downward from said top and passes beyond said bottom, said first and second sidewalls being substantially parallel to each other wherein said first and second sidewalls terminate in inwardly facing flanges thereby creating grooves on either side of said slideable lid that correspond to said first and second sides of said raised portion; and an aperture on said second end of said slideable lid; a retaining clip that is conformed to said first end of said raised member which provides a stop and securing point for said slideable lid when completely attached to said raised portion; a stem that extends through said bottom of said cylindrical base and that terminates at the top with a carburetor portion that seats into said first aperture in said raised member; and a bowl that fits into said carburetor portion; attaching said retrofitted lid to a water bottle, said water bottle having a reservoir pre-filled with water; placing said slideable lid over said raised portion such that said bowl is exposed yet said second aperture is covered; placing smokeable herbs into said bowl; placing a user's mouth on said aperture on said second end of said slideable lid; igniting said herbs in said bowl; inhaling through said aperture on said second end of said slideable lid; and releasing said bowl from said carburetor portion of said stem as needed to release smoke from said water bottle up through said second aperture in said raised portion and out through said aperture in said second end of said slideable lid.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
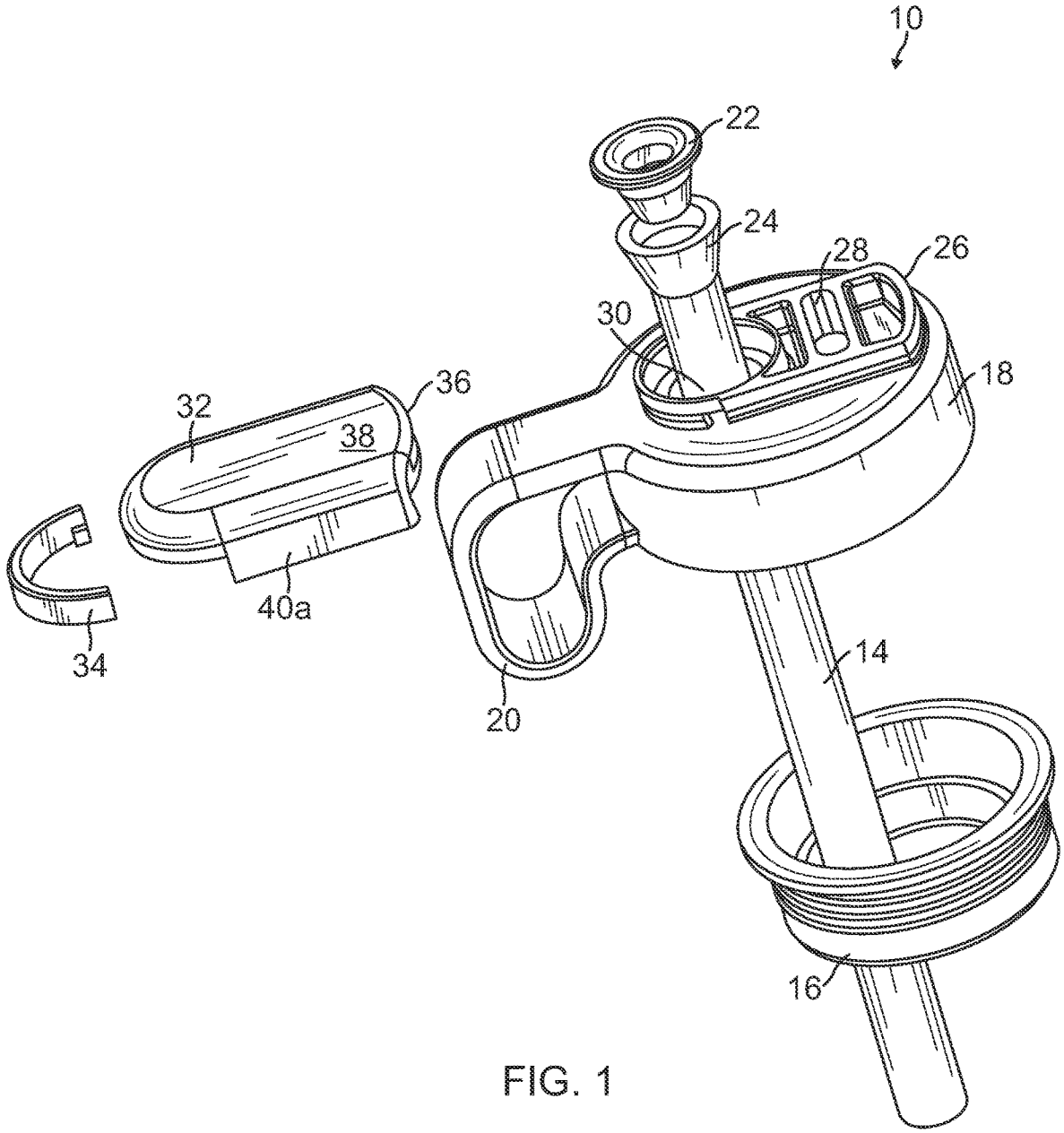
FIG. 1 is an exploded view of the retrofitted water bottle lid of the instant invention.
Figure 2:
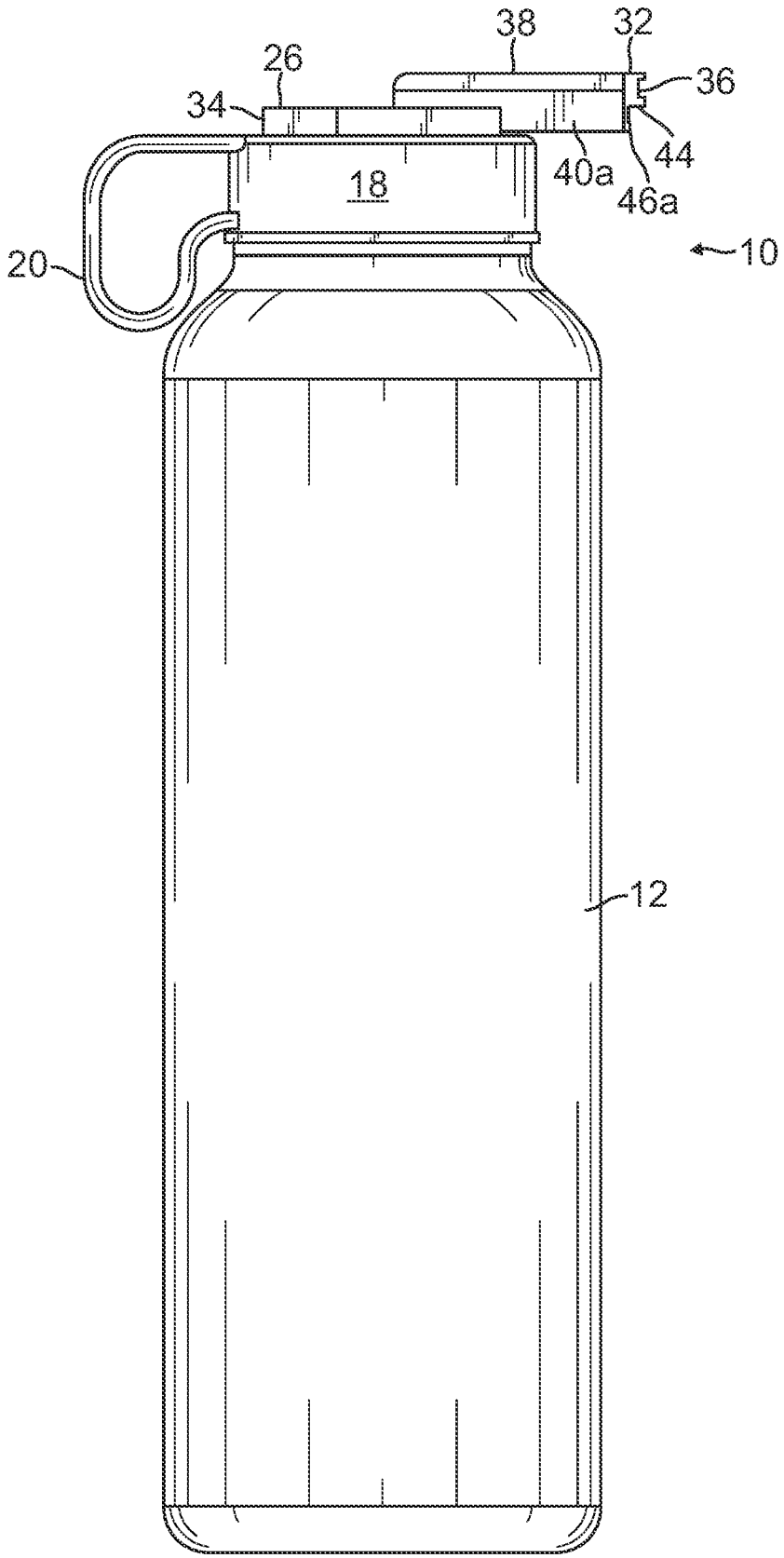
FIG. 2 is a side view of the retrofitted water bottle lid of the instant invention with the slideable lid on the top of the base open for use.
Figure 3:
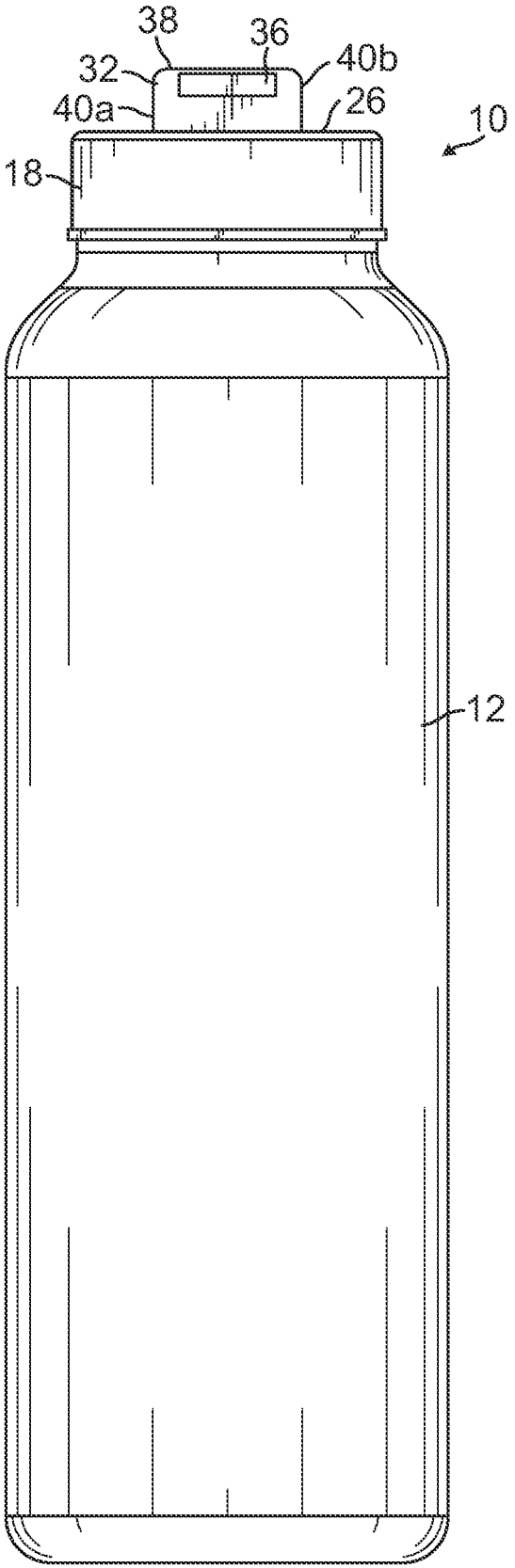
FIG. 3 is a front view of the retrofitted water bottle lid of the instant invention.
Figure 4:
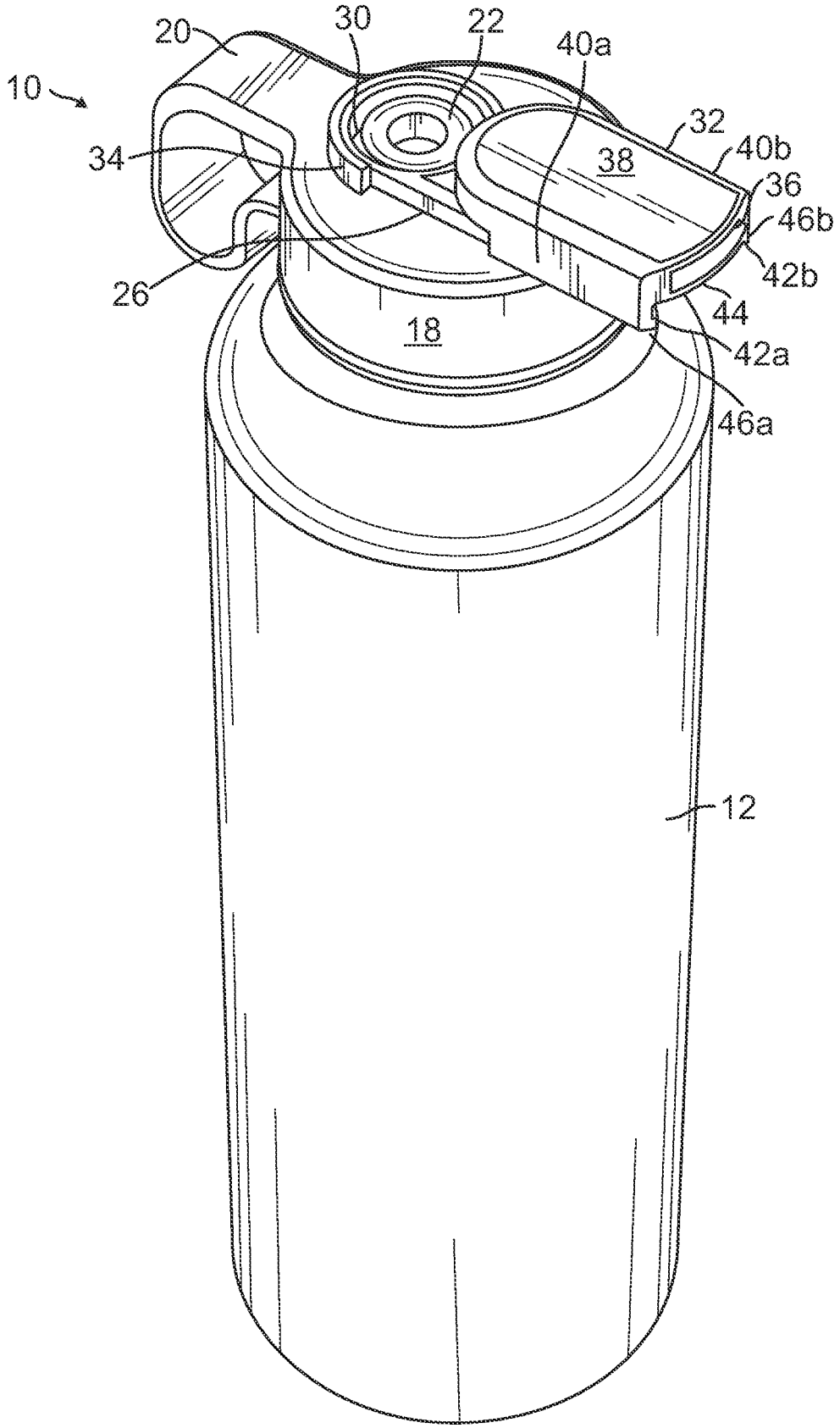
FIG. 4 is a top perspective of FIG. 2.
Figure 5:
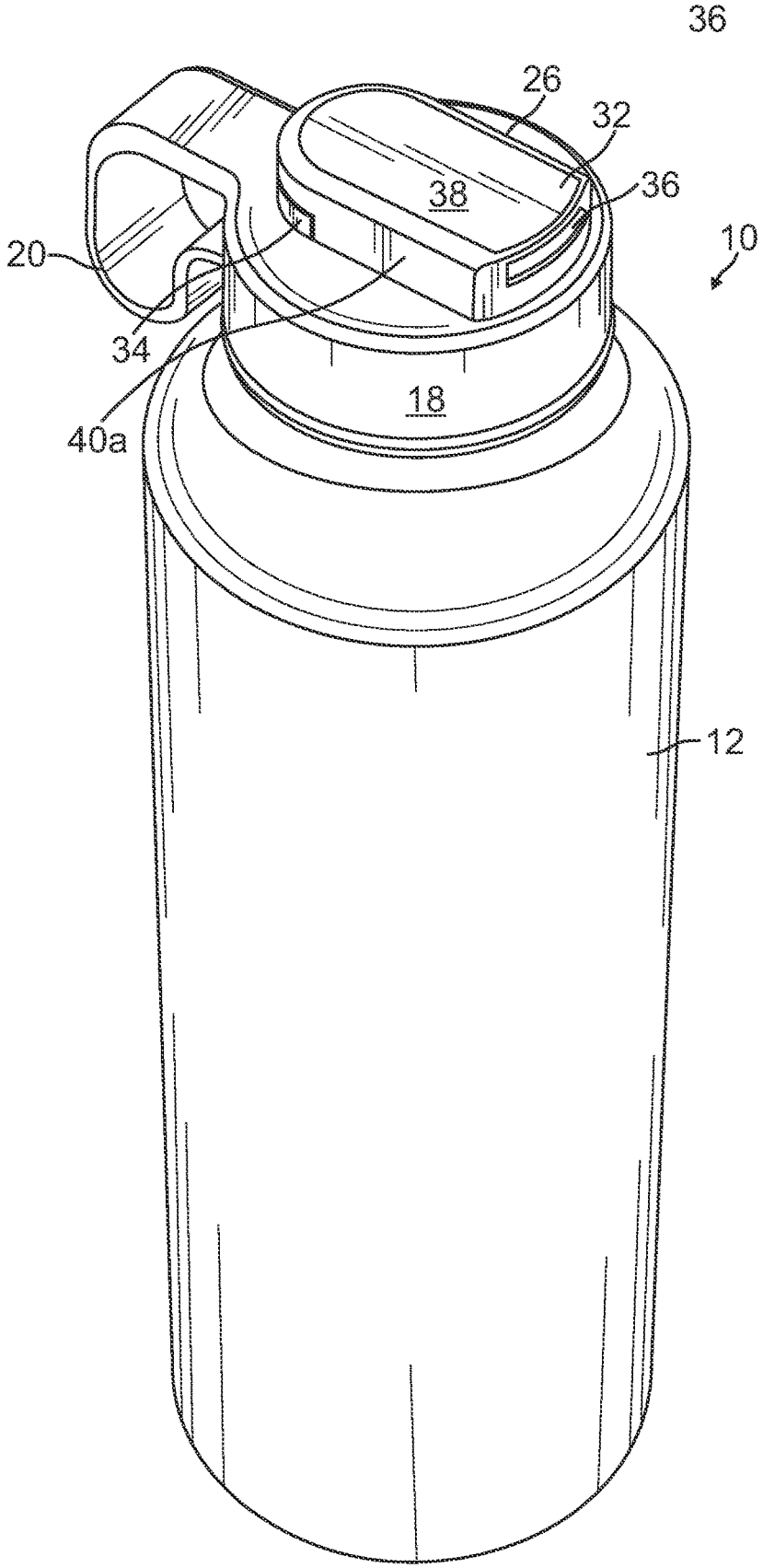
FIG. 5 is the same as FIG. 4 but with the slideable lid in the closed position.
Figure 6:
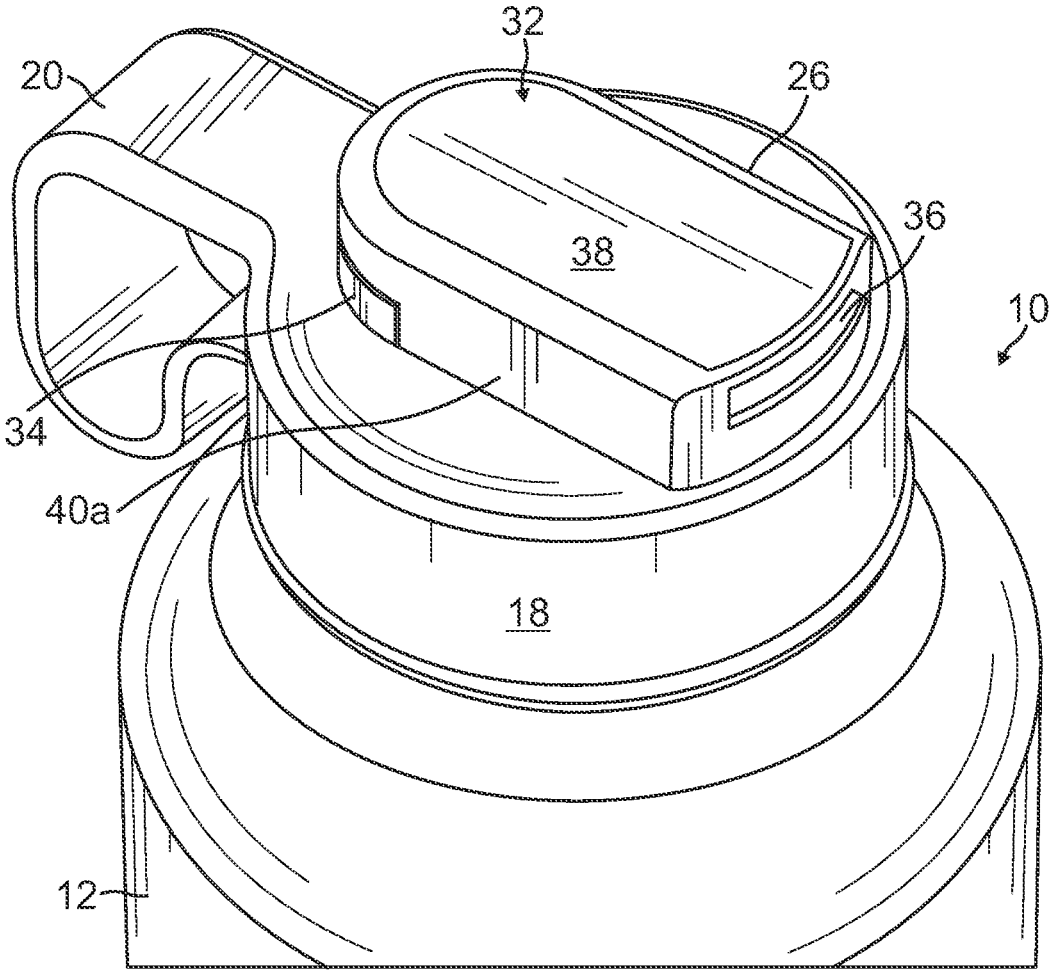
FIG. 6 is a close up view of the lid from FIG. 5.
Figure 7:
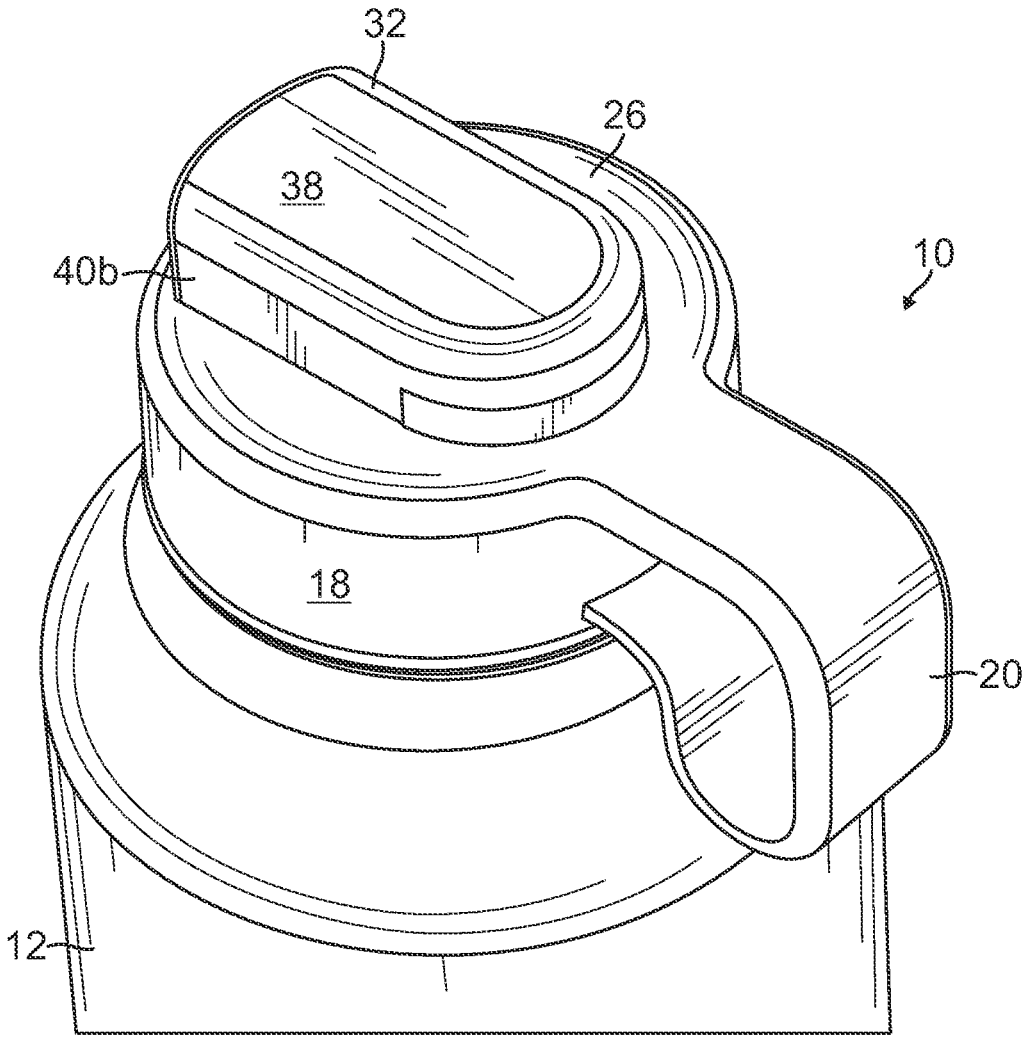
FIG. 7 is a top view of FIGS. 5 and/or 6.
Figure 8:
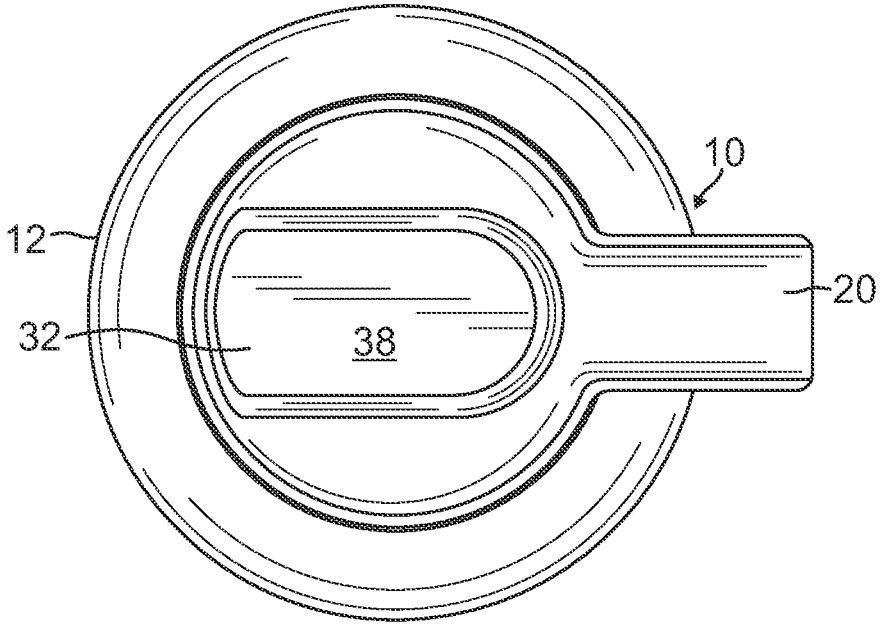
FIG. 8*s* is the same as FIG. 6 a rear view.
Figure 9:
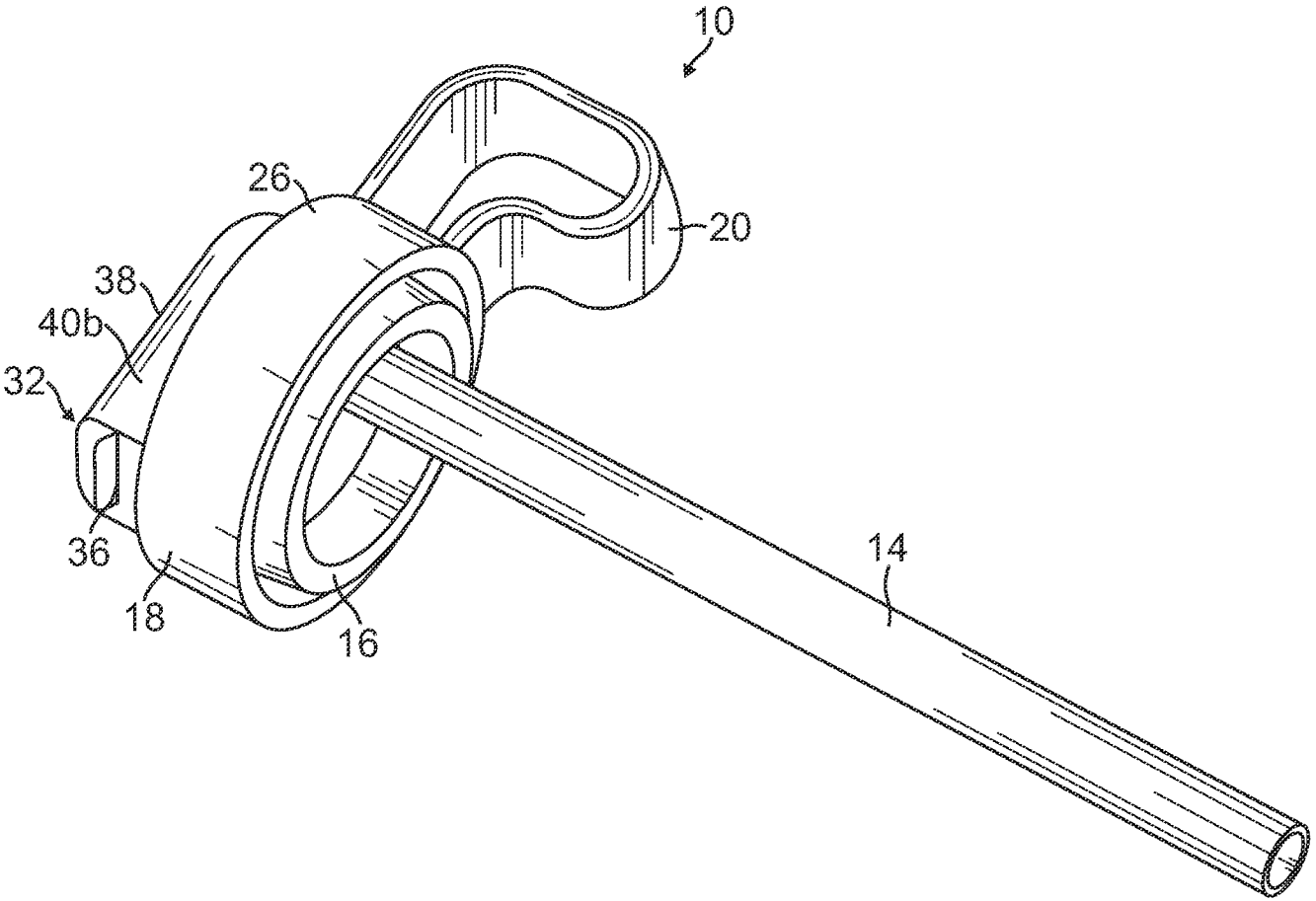
FIG. 9 is a bottom perspective view of the retrofitted water bottle lid of the instant invention.

Turning to the drawings, the preferred embodiment is illustrated and described by reference characters that denote similar elements throughout the several views of the instant invention.

The preferred embodiment of the instant invention provides for a fitting 10 that can transform a commonly used item, i.e., a metal reuseable water bottle 12, into a water pipe by attaching the fitting 10 where the lid is normally found.

The fitting 10 pushes down on top of the water bottle 12 where the lid would normally go. Downward from the inside of the fitting 10 is a stem 14 that inserts into the body of the water bottle 12 into water placed therein. At the top of the fitting 10 is a piece 32 that slides out through a groove to allow for the placement therein of the herbs to be smoked. The piece 32 that slides out to expose the area for placement of the herbs is hollow with an opening 36 on the outside end that is used as the mouth piece through which the user inhales the smoke.

The figures show various views of the invention. FIG. 1 is an exploded view showing all of the parts. The device 10 has a cylindrical base 18 with a handle 20 attached to it. The base 10 has a top 26 that is a substantially oblong shape onto which the slideable piece/lid 32 attaches and moves. On the end of the top 26 nearest the handle 20 the top 26 is arcuate and receives a retaining clip 34 that is detachable and that keeps the slideable lid 32 flush with the top 26. On the end distal from the handle 20 is where the slideable 32 attaches to the top 26.

The top 26 has a first rectangular aperture 28 that allows for the flow of smoke up from the water bottle 12 reservoir and out to the mouthpiece 36. The top 26 also has a round aperture 30 for the placement therethrough of the stem 14, capped by a carburetor portion 24 and a removable bowl 22 that seats therein. Below the base 18 is a cylindrical inverted cork 16 that allows for the device 10 to easily seat on the top of typical water bottle 12. The inverted cork 16 is preferably made of silicone.

The slideable lid 32 has a top 38 and a bottom 44. Between the top 38 and the bottom are two sidewalls 40A, 40B that extend downward from the top 38 and past the bottom 44 thereby creating a female mating space to match with the male top 26. The two sidewalls 40A, 40B terminate with inwardly directed flanges 46A, 46B that create grooves 42A, 42B that match perfectly with the sides of the top 26 of the device 10.

To use, a user acquires a water bottle 12 and fills it with water. Then the user places the device 10 base 18 over the top of the water bottle 12 where the lid would normally go. The stem 14 is immersed in the water and the inverted cork 16 provides a seal. The retaining clip 34 is attached to the top 26 portion proximate the handle 20 and can be left there. The stem 14 terminates in a carburetor portion 24 and fits in to the circular hole 30 in the top portion 26. The bowl 22 is seated into the carburetor 24 portion of the top 26. The smokeable herb is placed in the bowl 22. The slideable lid 32 is attached to the top portion 26 by sliding it on to the top portion 26 such that the slideable lid 32 sidewalls 40A, 40B mate with the top portion 26 and securely attaches. The slideable 32 is only slid so far such that the bowl 22 remains reachable by a match or lighter and such that the herbs can be ignited by the user. Additionally, the slideable lid 32 covers the rectangular aperture 28 in the top portion 26 so that smoke that is generated can pass through the water bottle 12 reservoir, through the top portion 26 and out the mouthpiece slot 36.

It is noted that the circular aperture 30 is closer to the handle 22 end of the device 10 while the rectangular aperture 28 is closer to the opposite end thereby allowing for the proper flow of smoke through the device 10.

The user then places his mouth on the mouthpiece slot 36 and lights the herbs in the bowl 22 and inhales. This brings the smoke generated down into the water inside of the water bottle 12 reservoir. The user can then lift the bowl 22 from the carburetor piece 24 which releases the smoke through the mouthpiece slot 36.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A retrofitted lid for a reuseable metallic water bottle comprising:

a cylindrical base portion, said cylindrical base portion having a top and a bottom and a cylindrical sidewall extending downward from said top and past said bottom creating a space thereunder;

an inverted cork place underneath said space under cylindrical base portion;

a raised member on said top of said cylindrical base portion wherein said raised member further comprises:

a first end;

a second end;

a first side between said first and second ends; and a second side between said first second ends;

a first aperture in said raised member that extends through said bottom of said cylindrical base portion;

a second aperture in said raised member that extends through said bottom of said cylindrical base portion;

a slideable lid for attachment to said raised member, said slideable lid further comprising:

a first end that corresponds to said first end of said raised member;

a second end that corresponds to said second end of said raised member;

a top;

a bottom;

a first sidewall that extends downward from said top and passes beyond said bottom;

a second sidewall that extends downward from said top and passes beyond said bottom, said first and second sidewalls being parallel to each other wherein said first and second sidewalls terminate in inwardly facing flanges thereby creating grooves on either side of said slideable lid that correspond to said first and second sides of said raised portion; and an aperture on said second end of said slideable lid;

a retaining clip that is conformed to said first end of said raised member which provides a stop and securing point for said slideable lid when completely attached to said raised portion;

a stem that extends through said bottom of said cylindrical base and that terminates at the top with a carburetor portion that seats into said first aperture in said raised member; and a bowl that fits into said carburetor portion.

2. The retrofitted lid as defined in claim 1 wherein said inverted cork is made of silicone.

3. The retrofitted lid as defined in claim 1 wherein said first aperture is circular.

4. The retrofitted lid as defined in claim 1 wherein said second aperture is rectangular.

5. The retrofitted lid as defined in claim 1 wherein said aperture on said second end of said slideable lid is rectangular.

6. The retrofitted lid as defined in claim 1 wherein a handle is attached to said cylindrical base.

7. The retrofitted lid as defined in claim 6 wherein said first aperture is proximate said handle and said second aperture is distal said handle.

8. A method of converting a standard water bottle into a water pipe comprising the steps of:

acquiring a retrofitted lid, said retrofitted lid further comprising:

a cylindrical base portion, said cylindrical base portion having a top and a bottom and a cylindrical sidewall extending downward from said top and past said bottom creating a space thereunder;

an inverted cork place underneath said space under cylindrical base portion;

a raised member on said top of said cylindrical base portion wherein said raised member further comprises:

a first end;

a second end;

a first side between said first and second ends; and a second side between said first second ends;

a first aperture in said raised member that extends through said bottom of said cylindrical base portion;

a second aperture in said raised member that extends through said bottom of said cylindrical base portion;

a slideable lid for attachment to said raised member, said slideable lid further comprising:

a first end that corresponds to said first end of said raised member;

a second end that corresponds to said second end of said raised member;

a top;

a bottom;

a first sidewall that extends downward from said top and passes beyond said bottom;

a second sidewall that extends downward from said top and passes beyond said bottom, said first and second sidewalls being parallel to each other wherein said first and second sidewalls terminate in inwardly facing flanges thereby creating grooves on either side of said slideable lid that correspond to said first and second sides of said raised portion; and an aperture on said second end of said slideable lid;

a retaining clip that is conformed to said first end of said raised member which provides a stop and securing point for said slideable lid when completely attached to said raised portion;

a stem that extends through said bottom of said cylindrical base and that terminates at the top with a carburetor portion that seats into said first aperture in said raised member; and a bowl that fits into said carburetor portion;

attaching said retrofitted lid to a water bottle, said water bottle having a reservoir pre-filled with water;

placing said slideable lid over said raised portion such that said bowl is exposed yet said second aperture is covered;

placing smokeable herbs into said bowl;

placing a user's mouth on said aperture on said second end of said slideable lid;

igniting said herbs in said bowl;

inhaling through said aperture on said second end of said slideable lid; and releasing said bowl from said carburetor portion of said stem as needed to release smoke from said water bottle up through said second aperture in said raised portion and out through said aperture in said second end of said slideable lid.

* * * * *